US011774207B1

(12) United States Patent
Spence

(10) Patent No.: US 11,774,207 B1
(45) Date of Patent: Oct. 3, 2023

(54) PAINTBALL GUN BARREL SYSTEM

(71) Applicant: Daniel Spence, Auburn, AL (US)

(72) Inventor: Daniel Spence, Auburn, AL (US)

( * ) Notice: Subject to any disclaimer, the term of this patent is extended or adjusted under 35 U.S.C. 154(b) by 0 days.

(21) Appl. No.: 17/824,962

(22) Filed: May 26, 2022

(51) Int. Cl.

| | |
|---|---|
| ***F41A 21/10*** | (2006.01) |
| ***F41A 11/02*** | (2006.01) |
| ***F41B 11/00*** | (2013.01) |
| ***F41A 21/48*** | (2006.01) |
| ***F41B 11/62*** | (2013.01) |

(52) U.S. Cl.
CPC ..... *F41A 21/48* (2013.01); *F41A 21/10* (2013.01); *F41B 11/62* (2013.01)

(58) Field of Classification Search
CPC ..... F41A 21/04; F41A 21/10; F41A 11/02; F41A 11/04; F41A 11/06
See application file for complete search history.

(56) References Cited

U.S. PATENT DOCUMENTS 1,217,347 A 2/1917 Rosengarten
1,772,505 A * 8/1930 Wells ..... F41A 21/04 89/16
2,117,935 A 5/1938 Benjamin et al.
2,605,756 A 8/1952 Bertschinger
3,138,889 A 6/1964 Groover
3,156,985 A 11/1964 Mellor et al.
3,339,304 A 9/1967 Knode et al.
3,384,989 A 5/1968 Thomas
3,640,013 A 2/1972 Franklin
3,708,841 A * 1/1973 Quinney ..... F41A 11/02 124/84
3,805,434 A 4/1974 Sudano
4,641,450 A * 2/1987 Moll ..... C23C 14/0635 138/140
4,644,930 A 2/1987 Mainhardt
6,494,195 B2 * 12/2002 Perry ..... F41B 11/00 42/76.01
6,668,815 B1 * 12/2003 Fernandez ..... F41A 11/00 285/341
6,698,128 B2 * 3/2004 Kessler ..... F41B 11/00 89/14.05
6,823,857 B2 11/2004 Perry et al.
7,076,905 B2 * 7/2006 Zouboulakis ..... F41A 21/482 42/76.01
7,691,759 B2 4/2010 Perry et al.
7,980,238 B2 1/2011 Wood
8,397,706 B2 3/2013 Wood
8,910,411 B1 * 12/2014 Calvert ..... F41A 21/325 42/105
9,091,502 B1 * 7/2015 Morrison ..... F41G 11/001
(Continued)

*Primary Examiner* — Derrick R Morgan
(74) *Attorney, Agent, or Firm* — Peter Loffler

(57) ABSTRACT

A three-component barrel system for a paintball gun uses a barrel back that threadably couples to the gun. A barrel tip is magnetically coupled to the barrel back. A barrel insert, through which the paintballs are actually fired, is received within the hollow interior formed by the coupled barrel back and barrel tip. The barrel insert has porting thereon as does the barrel tip the two sets of porting correspond with one another. A channel within the barrel tip slidably receives a peg on an exterior of the barrel insert in order to assure proper alignment between barrel tip and barrel insert. The bore of the barrel insert can taper outwardly in proceeding from its breach end to its muzzle end.

20 Claims, 9 Drawing Sheets

(56) References Cited

U.S. PATENT DOCUMENTS

| | | | | |
|---|---|---|---|---|
| 9,587,909 | B1 * | 3/2017 | Askin | F41F 1/00 |
| 11,236,961 | B1 * | 2/2022 | Pineda | F41A 21/482 |
| 2002/0179074 | A1 | 12/2002 | Sullivan, Jr. | |
| 2003/0041849 | A1 * | 3/2003 | Perry | F41A 21/04 124/84 |
| 2003/0182838 | A1 * | 10/2003 | Kessler | F41A 21/00 42/79 |
| 2005/0183712 | A1 * | 8/2005 | Goepfert | F41B 11/00 124/83 |
| 2006/0064914 | A1 * | 3/2006 | Greer | F41A 11/02 42/77 |
| 2006/0101697 | A1 * | 5/2006 | Bushnell | F41A 21/16 42/76.01 |
| 2006/0249130 | A1 * | 11/2006 | Ho | F41B 11/00 124/1 |
| 2010/0154764 | A1 * | 6/2010 | Liao | F41A 9/55 124/44.7 |
| 2011/0000474 | A1 * | 1/2011 | Wood | F41A 11/02 29/401.1 |
| 2012/0144713 | A1 * | 6/2012 | Dubois | F41A 21/482 42/50 |
| 2013/0139715 | A1 * | 6/2013 | Bleicken | F42B 3/22 102/311 |
| 2014/0007857 | A1 * | 1/2014 | Schlosser | F41B 11/70 124/84 |
| 2014/0230802 | A1 | 8/2014 | Cort | |
| 2018/0080733 | A1 * | 3/2018 | Battaglia | F41A 21/484 |
| 2018/0202736 | A1 * | 7/2018 | Teetzel | F41A 11/02 |
| 2018/0283821 | A1 * | 10/2018 | Dodson | F41A 21/12 |
| 2020/0141682 | A1 * | 5/2020 | McMillan | F41A 21/10 |
| 2021/0041201 | A1 * | 2/2021 | Seghi | F41A 21/484 |
| 2021/0404785 | A1 * | 12/2021 | Sasnett | F42D 5/04 |
| 2023/0022445 | A1 * | 1/2023 | Painter | F41A 21/44 |

* cited by examiner

PAINTBALL GUN BARREL SYSTEM

BACKGROUND OF THE INVENTION

1. Field of the Invention

The present invention relates to a system that allows for the rapid interchange of barrels on a paintball gun and also provides for an outer sleeve for the barrel, which outer sleeve allows for aesthetic customization of the paintball gun.

2. Background of the Prior Art

Paintball gun barrels typically consist of a tube of aluminum, either a single piece or multiple pieces that are screwed to one another in typical fashion with the proximal end—the breach end—of the barrel threadably attached to the paintball gun. The distal end—the muzzle end—of the barrel has holes drilled thereinto for porting of the barrel. The porting allows air to escape when a paintball is fired, making the paintball traveling down the barrel quieter without the paintball losing much energy and thus velocity. The paintballs are discharged from the muzzle end of the barrel around 280-300 feet per second and can be fired at a rate of approximately 12.5 paintballs per second.

In tournament play, the paintball barrel system is typically of two-piece constructions having a barrel back that threadably attaches to the gun proper and a barrel tip that has the porting and that threadably attaches to the barrel back. The barrel back has the critical bore that matches up to the caliber of the paintball being fired. The bore of the barrel tip is somewhat larger and tends not to play a role in performance of the gun. During tournament play, the barrel back is often switched one or more times per day in order to best match the bore of the barrel back to the size of the paintballs being fired in order to maximize the performance of the paintball gun.

In order to change out the barrel back, and thus change the effective bore size of the barrel, the barrel tip must be unscrewed from the barrel back and the barrel back must be unscrewed from the gun. The new barrel back is screwed onto the gun, and finally the barrel tip is screwed to the barrel back. The process is time consuming and frustrating and players tend not to be fond of performing this task What is needed is a system that allows a paintball player to be able to change the effective bore size of the barrel in relatively quick and easy fashion so as not to be deterred from performing this swap out necessary task. Such a system must be easy to implement so that a player can perform the bore swap very fast without the frustration and time devotion currently required.

SUMMARY OF THE INVENTION

The paintball gun barrel system of the present invention addresses the aforementioned needs by providing a system whereby the effective bore size of the paintball gun barrel can be changed in just a few seconds so as to not frustrate the player with a time-consuming task. The paintball gun barrel system is quick and easy to implement. The paintball gun barrel system is of relatively simple design and construction, making the system relatively inexpensive to produce using standard manufacturing techniques so as to make the system economically attractive to potential consumers for this type of device. The paintball gun barrel system allows for aesthetic customization of the paintball gun.

The paintball gun barrel system of the present invention is comprised of a hollow tubular barrel back that has first end that is removably attached to the discharge port of the paintball gun, the barrel back also has an opposing second end. One or more magnets are located on the second end of the barrel back, the magnet either forming or disposed within a seat. A hollow tubular barrel tip has a first inner surface, a coupling end, and a port end. The coupling end of the barrel tip has magnetically attractive material thereat (either being made from or coated with magnetically attractive material). The coupling end is received within the formed seat such that the coupling end is magnetically coupled to the magnet(s). The coupled barrel tip and barrel port form a continuous first hollow interior. A hollow tubular barrel insert has a second inner surface, an outer surface, a second hollow interior, a breach end, and a muzzle end. The barrel insert is received within the first hollow interior such that the breach end of the barrel insert abuts the paintball gun. The magnet may be a ring magnet or can be a series of circumferentially positioned smaller magnets. A series of first ports is located on the barrel tip proximate the port end while a series of second ports is located on the barrel insert such that the first ports align with the second ports. A peg is located on the outer surface of the barrel insert. A channel is disposed within the first inner surface of the barrel tip and extends from the coupling end toward the port end. The peg is received within the channel when the barrel insert is received within the first hollow interior in order to properly align the first ports and the second ports and to prevent the barrel insert from spinning within the hollow interior formed by the barrel back and barrel tip. The barrel insert has a first inside diameter at the breach end and a second inside diameter located at the muzzle end such that the second diameter is greater than the first diameter. The second inner surface has a friction reducing coating thereon.

BRIEF DESCRIPTION OF THE DRAWINGS

Similar reference numerals refer to similar parts throughout the several views of the drawings.

DESCRIPTION OF THE PREFERRED EMBODIMENT

Figure 1:
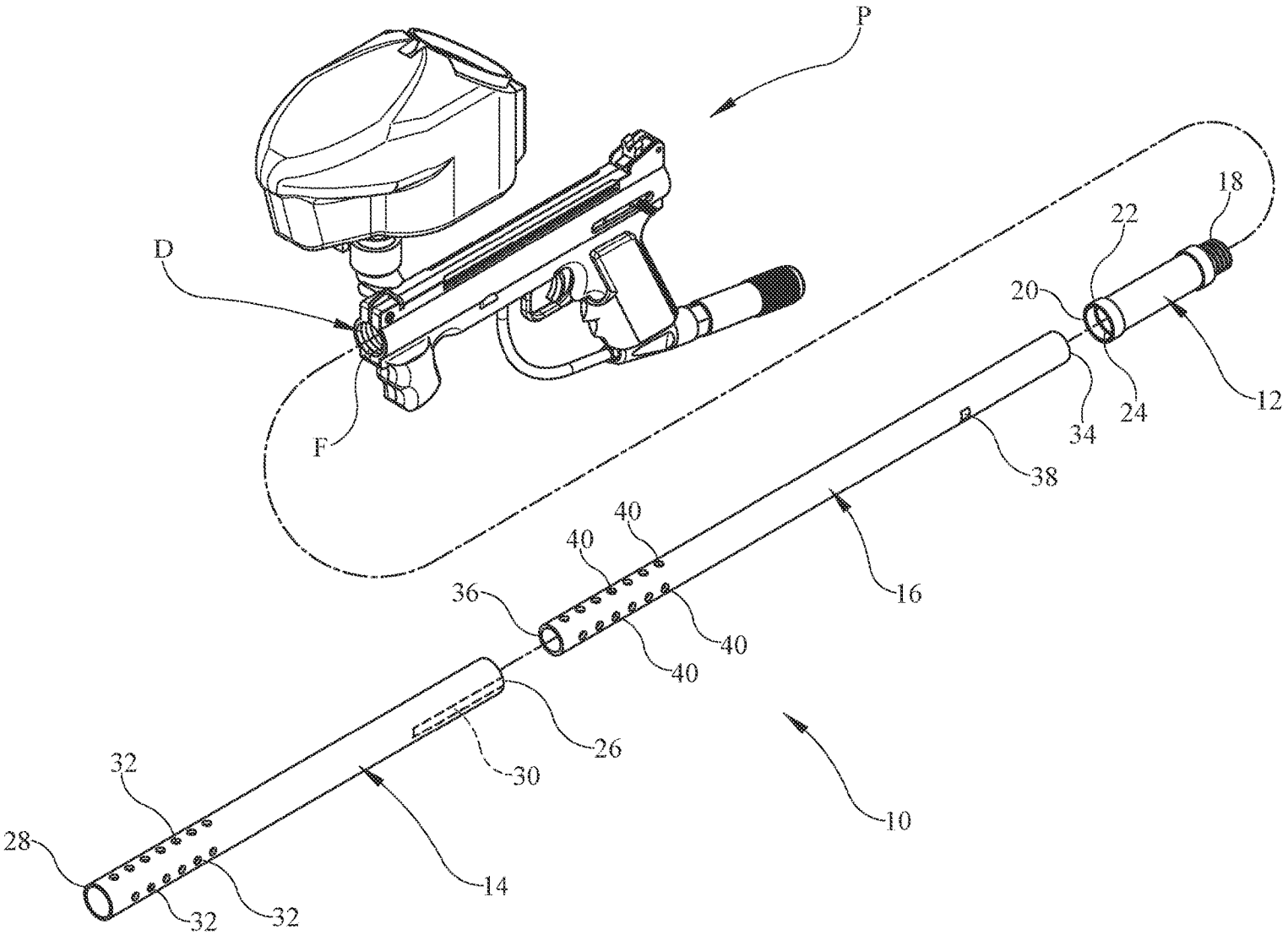
FIG. 1 is an exploded perspective view of the paintball gun barrel system of the present invention.
Figure 2:
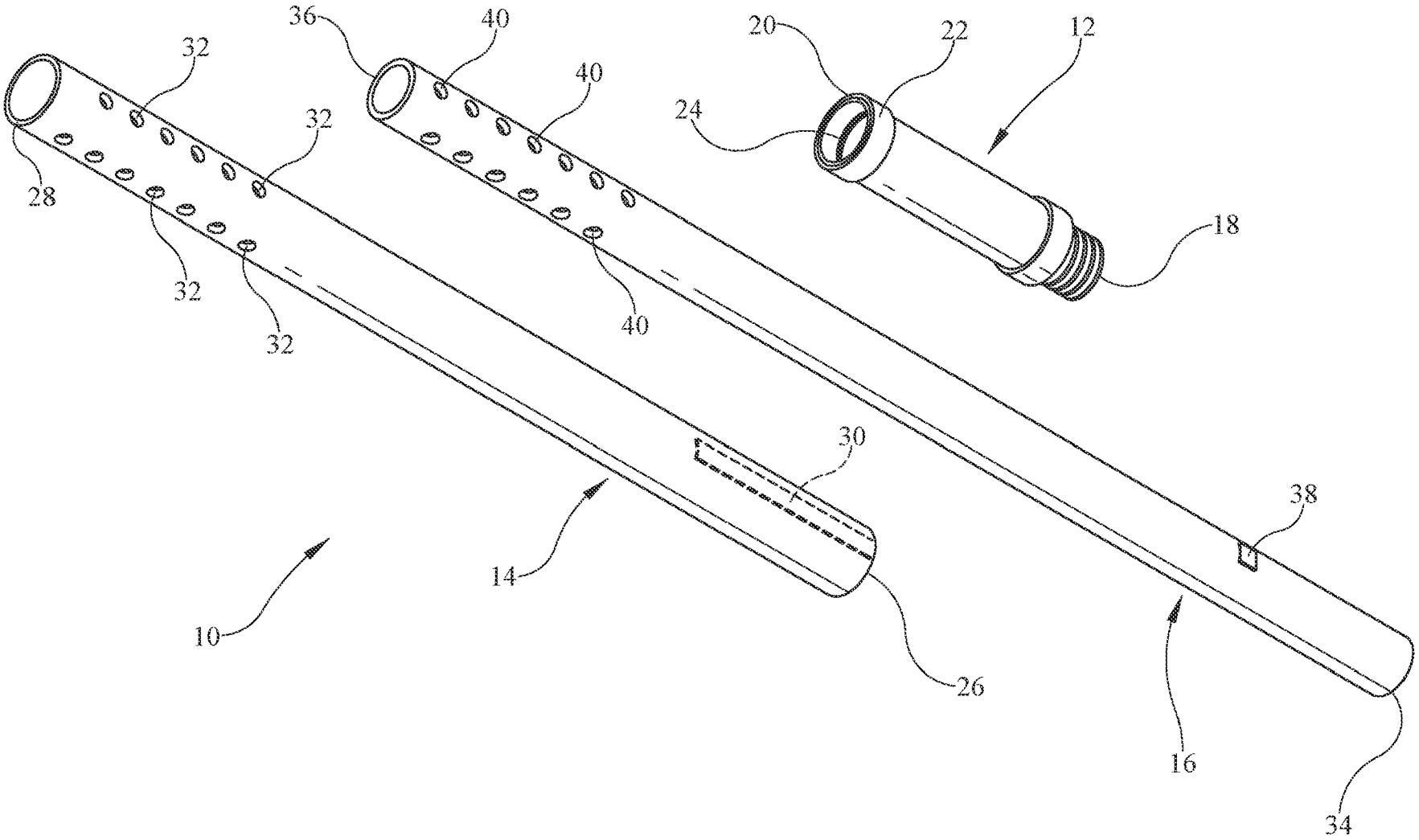
FIG. 2 is a perspective view of the various components of the paintball gun barrel system.
Figure 3:
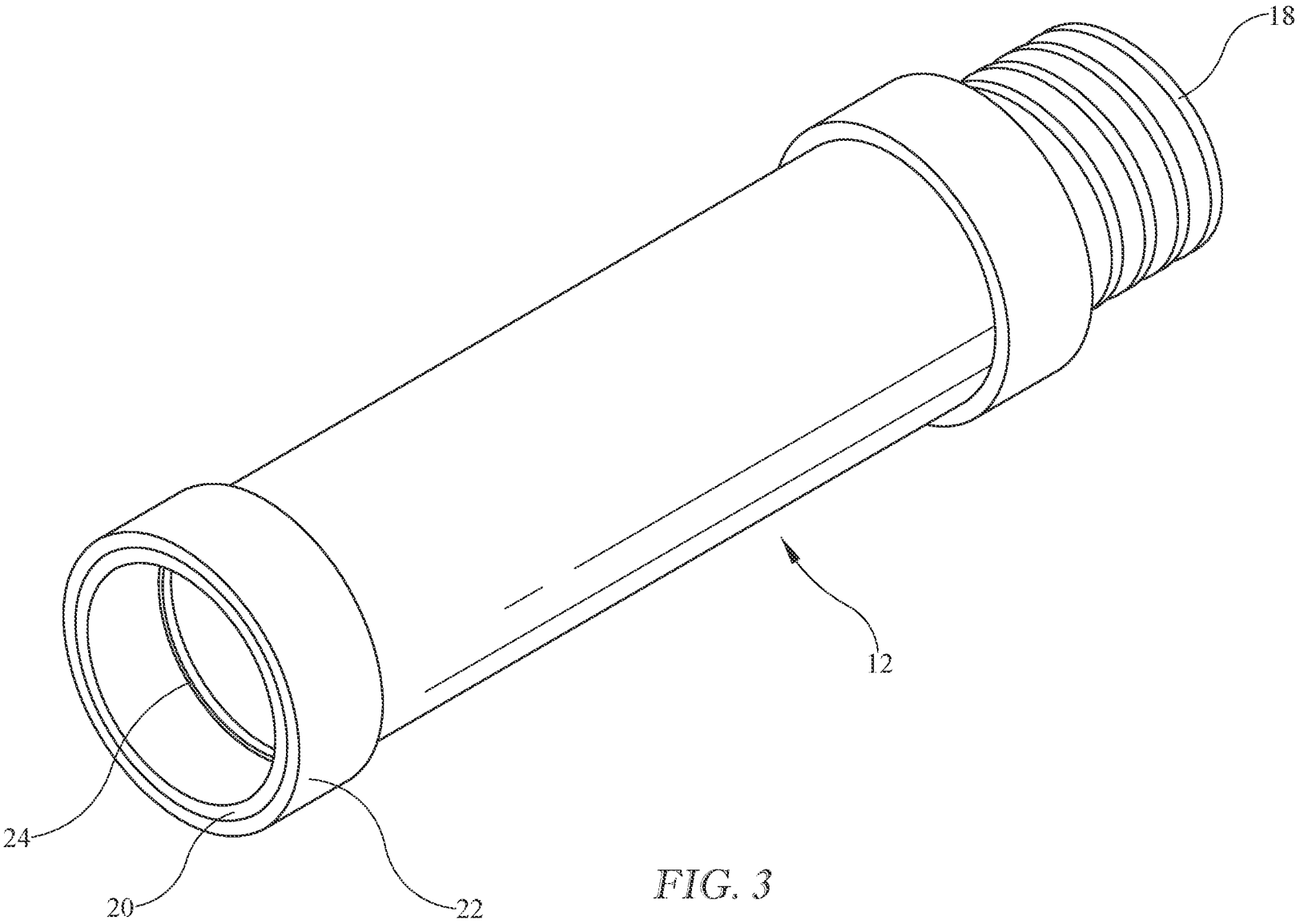
FIG. 3 is a perspective view of the barrel back of the paintball gun barrel system.
Figure 4:
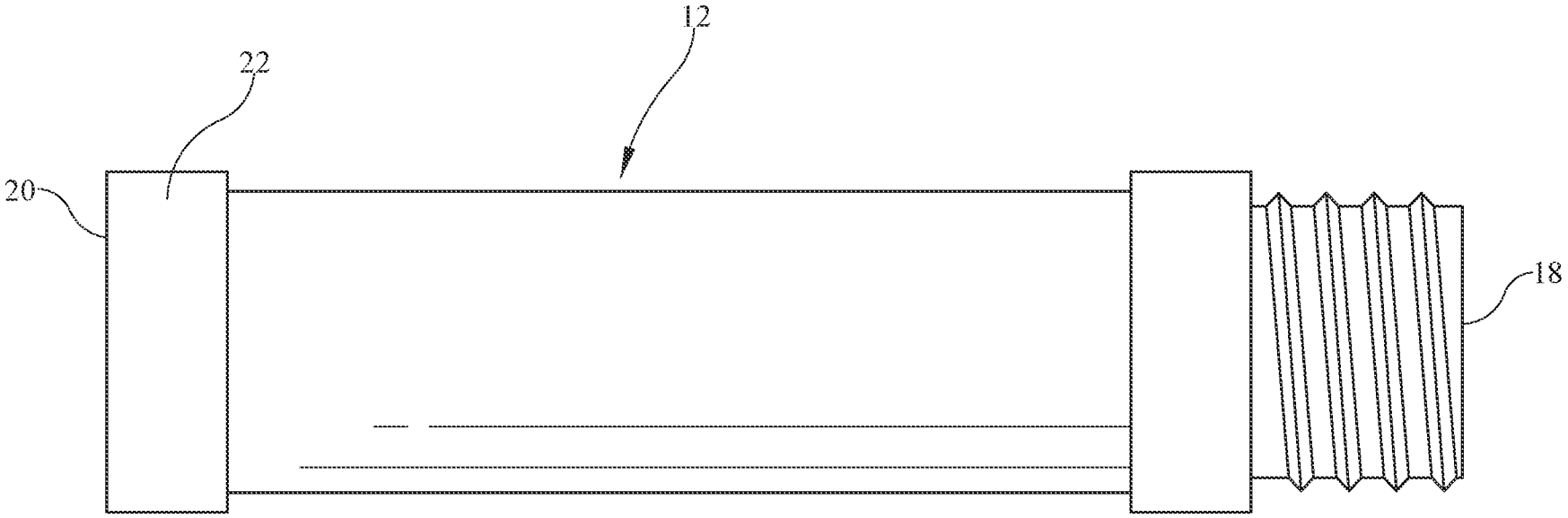
FIG. 4 is a side view of the barrel back of the paintball gun barrel system.
Figure 5:
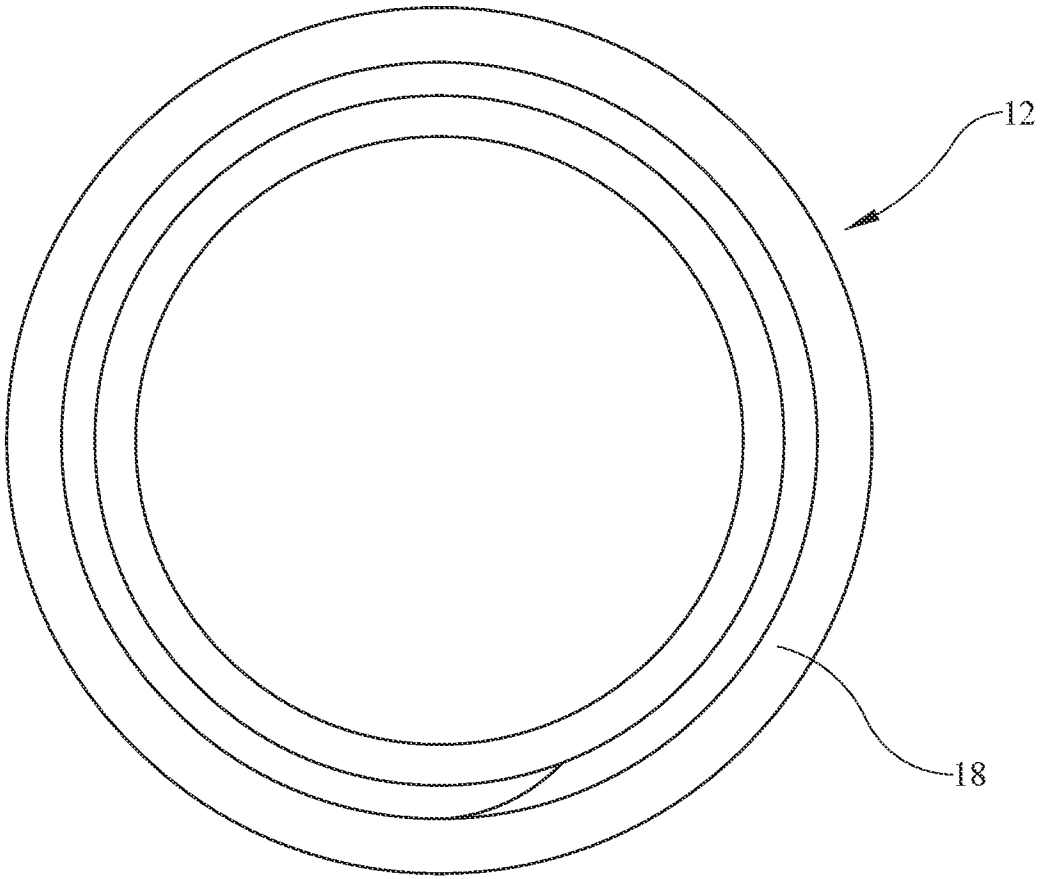
FIG. 5 is an end view of the barrel back of the paintball gun barrel system.
Figure 6:
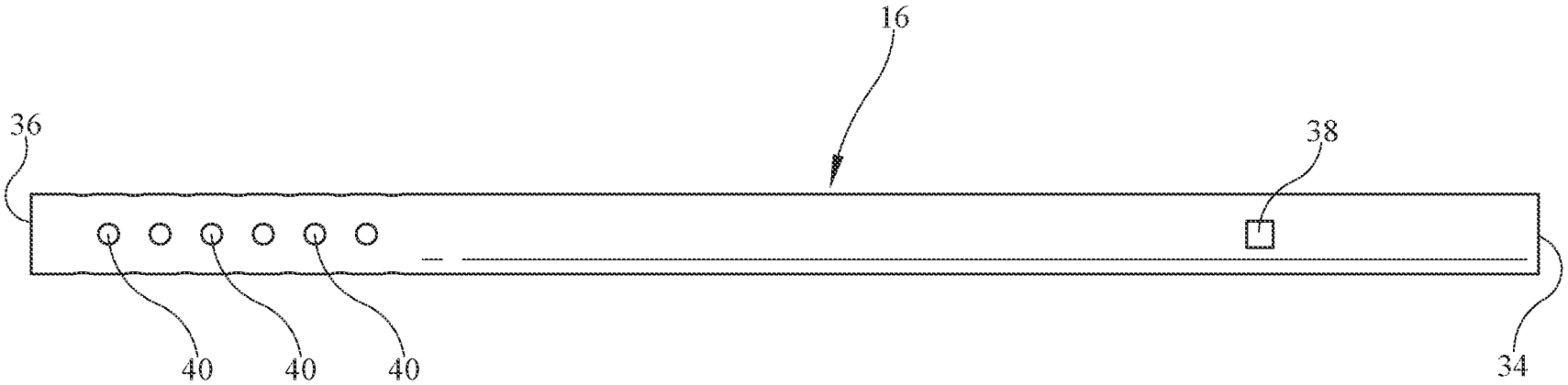
FIG. 6 is a side view of the barrel insert of the paintball gun barrel system.
Figure 7:
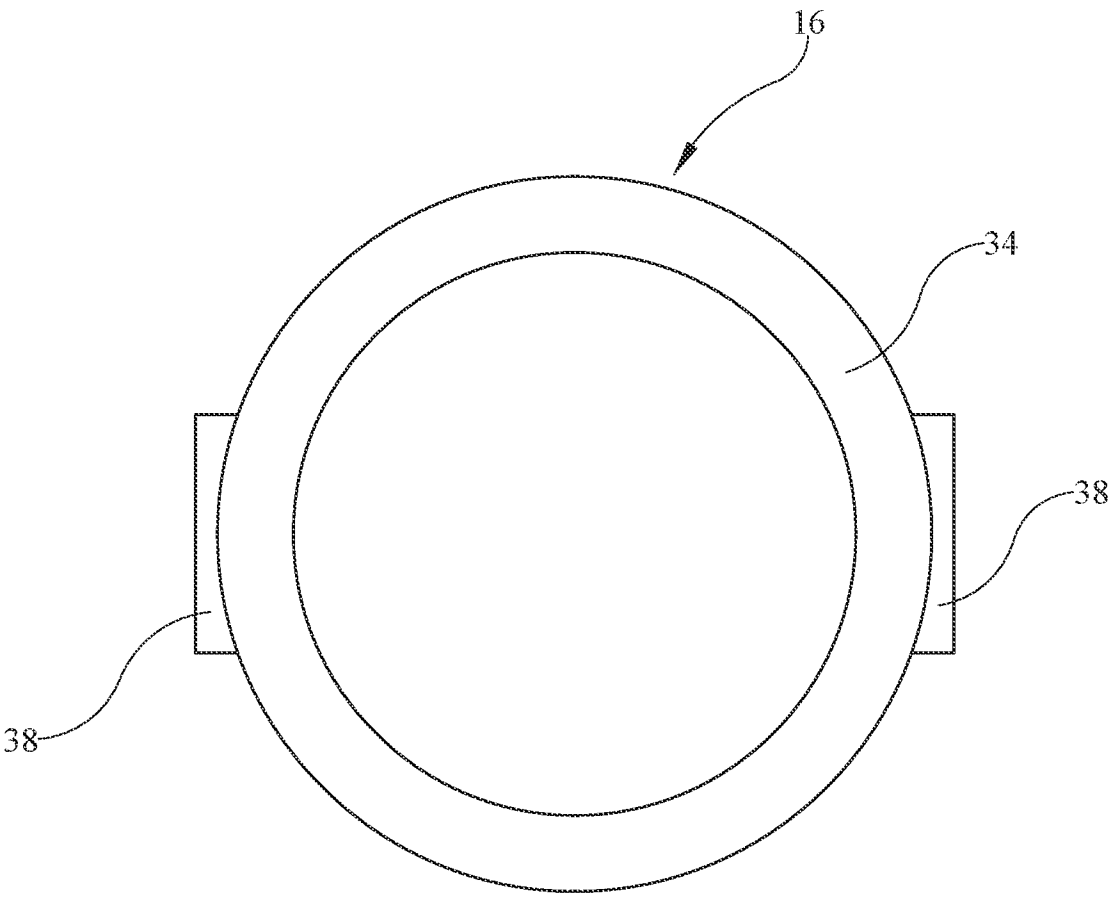
FIG. 7 is an end view of the barrel insert of the paintball gun barrel system.
Figure 8:
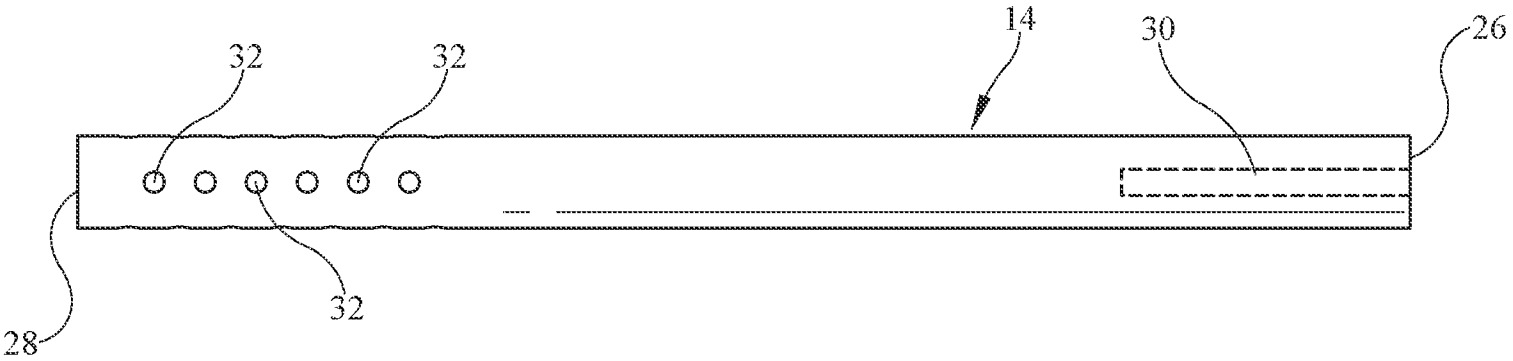
FIG. 8 is a side view of the barrel tip of the paintball gun barrel system.
Figure 9:
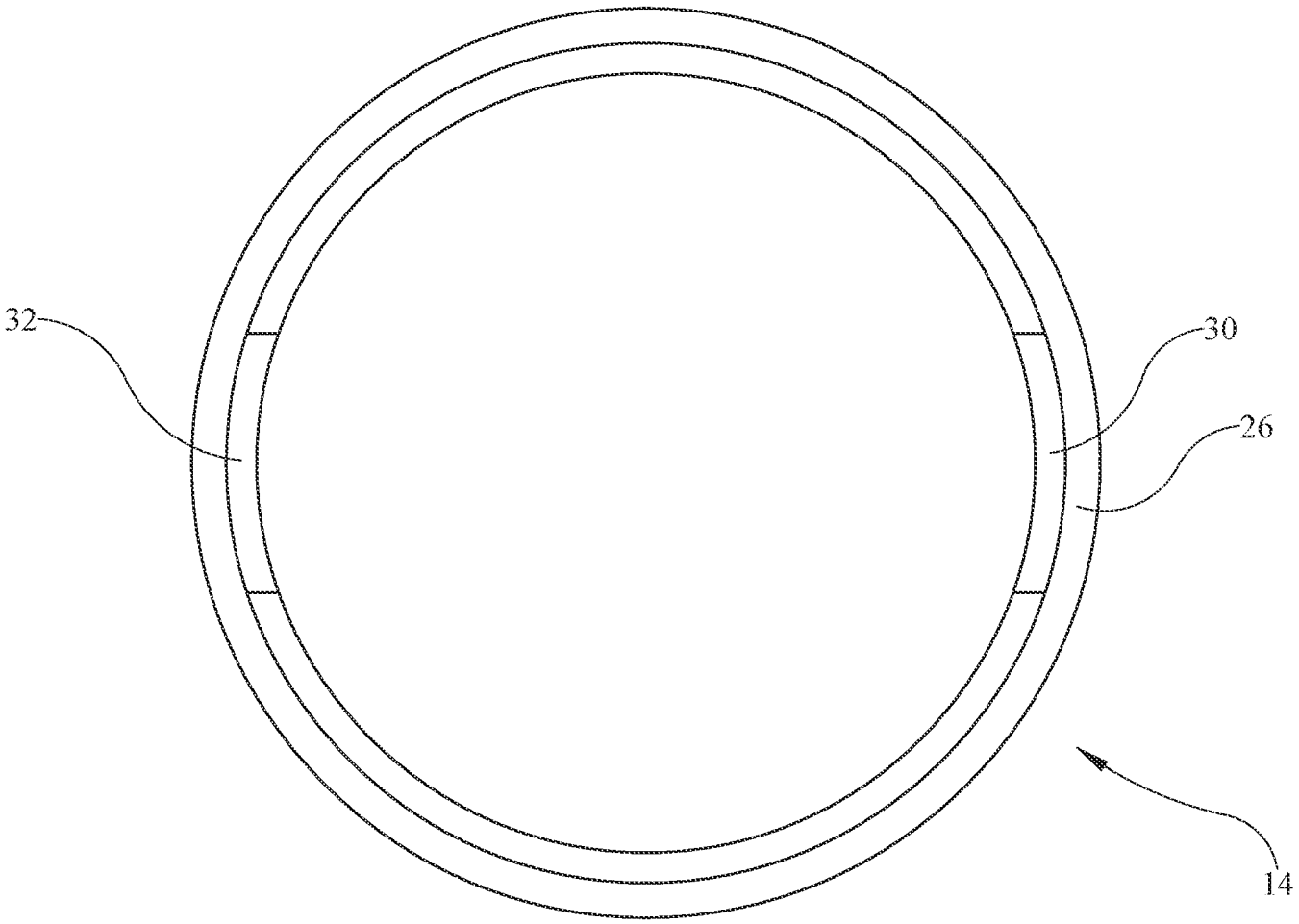
FIG. 9 is an end view of the barrel tip of the paintball gun barrel system when viewed from the barrel tip's coupling end.

Referring now to the drawings, it is seen that the paintball gun barrel system of the present invention, generally denoted by reference numeral 10, is comprised of three main components, a barrel back 12, a barrel tip 14 that attaches to the barrel back 12, and a barrel insert 16 that is received within the attached barrel back 12—barrel tip 14 combination, all of which have hollow interiors.

The barrel back 12 is a relatively short tubular member that has a first or threaded end 18 and an opposing second or magnet end 20. The threaded end 18 of the barrel back 12 is threadably received within the discharge port D of a paintball gun P. The magnet end 20 of the barrel back 12 has one or more magnets 22 attached thereto so as to circumferentially encircle the magnet end 20, the magnet 22, being of any appropriate shape, such as a ring magnet (illustrated) or a series of round or rectangular magnets circumferentially located at the magnet end 20. The magnet 22 is of any appropriate magnetic material such as being a rare earth permanent magnet. A seat 24 is also located at the magnet end 20 of the barrel tip 14, the seat 24 being the inner surface of which is magnetized.

The barrel tip 14 is a medium length tubular member that has a coupling end 26 and a port end 28. The coupling end 26 of the barrel tip 14 has one or more channels 30 located on an inner surface thereof, extending from the coupling end 26 toward the port end 28. A series of first ports 32 are located on the barrel tip 14 proximate the port end 28 thereof. The coupling end 26 of the barrel tip 14 is either made from a magnetically attractive material or has a layer of magnetically attractive material (not illustrated) encircling an outer surface thereof.

The barrel back 12 and the barrel tip 14 are coupled with one another by inserting the coupling end 26 of the barrel tip 14 into the magnetized seat 24. As the coupling end 26 of the barrel tip 14 is either made from or layered with a magnetically attractive material, the coupling end 26 of the barrel tip 14 is magnetically coupled to the magnet end 20 of the barrel back 12, the magnet(s) 22 being of sufficient magnetic strength to hold the two units 12 and 14 firmly together. Once the barrel back 12 and the barrel tip 14 are magnetically coupled to one another, they form a continuous hollow interior that has uniform inside diameter. It is recognized that the magnet(s) and the pocket may be located on the barrel tip and the distal end (opposite the threaded end) is made from or layered with a magnetically attractive material, the two configurations being equivalents of one another.

The barrel back 12 and the barrel tip 14 are made from any appropriate material, such as aluminum, or to save weight from a sturdy plastic or composite material. The inner diameter of the barrel back 12 and the inner diameter of the barrel tip 14 are substantially similar other than at the seat 24 of the barrel back 12, which seat 24 has a greater inside diameter. The two coupled units 12 and 14 form a hollow interior.

The barrel insert 16 is a relatively long and relatively thin tubular member made from aluminum or other similar material. The barrel insert 16 has a breach end 34 and a muzzle end 36. One or more pegs 38 are located on an outer surface of the barrel insert 16 slightly offset from the breach end 34 thereof. The inner surface of the barrel insert 16 may be highly polished or may be coated with nickel or tungsten disulfide or other similar friction reducing material. A series of second ports 40 are located on the barrel insert 16 proximate the muzzle end 36 thereof. The series of second ports 40 correspond with the series of first ports 32 located on the barrel tip 14 when the units are combined as more fully explained below. The inside diameter of the barrel insert 16 is the bore of the overall paintball gun P through which the paintball is fired. This inside diameter may be constant throughout the bore's length or may taper outwardly in proceeding from the breach end 34 to the muzzle end 36. The outside diameter of the barrel insert 16 is sized to be slightly smaller than the connected barrel back 12 and barrel tip 14 so as to be snugly received within the connected barrel back 12 and barrel tip 14 as more fully explained below.

In order to use the paintball gun barrel system 10 of the present invention, the barrel back 12 is mated with the paintball discharge port D of the paintball gun P by threadably mating the male threading on the threaded end 18 of the barrel back 12 with the corresponding female threading F on thee discharge port D of the paintball gun P. A barrel insert 16 is selected based on the needed bore size (inner diameter of the barrel insert 16) and the desired porting configuration (second ports 40). The breach end 34 of the barrel insert 16 is inserted into the barrel tip 12 until the breach end 34 abuts against the paintball gun P. A barrel tip 14 is selected that has a porting configuration (first ports 32) that correspond with the porting configuration off the barrel insert 16. The coupling end 26 of the barrel tip 14 is positioned so as to receive the muzzle end 36 of the barrel insert 16 and is slid over the barrel insert 16. The channels 30 of the barrel tip 14 are aligned with the pegs 38 of the barrel insert 16 so that the pegs 38 each enter a respective one of the channels 30—the pegs 38 and channels 30 being dimensioned so that there is a snug fit of peg 38 within its respective channel 30. Sliding of the barrel tip 14 over the barrel insert 16 is continued until the coupling end 26 of the barrel tip 14 is seated within the seat 24 of the barrel back 12. Once the barrel tip 14 is so seated, the magnet(s) 22 on the barrel back 12 magnetically couple with the magnetically attractive material of the coupling end 26 of the barrel tip 14, thereby firmly coupling the barrel back 12 with the barrel tip 14. The pegs 38 within their respective channels 30 provide a steady securement of the coupled barrel back 12—barrel tip 14 combination with the barrel insert 16 and prevent rotation of the barrel back 12—barrel tip 14 combination about the barrel insert 16 and also assure that the first ports 32 and the second ports 40 are aligned with one another. When the paintball gun P fires a paintball, the paintball enters the hollow interior of the barrel insert 16 at the breach end 34, travels through the hollow interior of the barrel insert 16, and is discharged through the muzzle end 36.

In order to change bore size of the barrel proper, the barrel tip 14 is pulled with sufficient force to overcome its magnetic coupling with the barrel back 12 and is slid off of the barrel insert 16. The barrel insert 16 is removed and the new barrel insert 16 is attached to the overall paintball gun P as described above. If the porting configuration on the new barrel insert 16 changes, then a new barrel tip 14 Is also retrieved so that the new barrel tip 14 has a porting configuration that matches the porting configuration on the new barrel insert 16. The barrel tip 14 is replaced as described above. This operation is quick, easy, and efficient.

The outer surface of the barrel back 12—barrel tip 14 combination can be aesthetically decorated as desired. This can include making the combination in different colors, in camouflage livery, with corporate logos thereon or other forms of advertising, etc.

While the invention has been particularly shown and described with reference to an embodiment thereof, it will be appreciated by those skilled in the art that various changes in form and detail may be made without departing from the spirit and scope of the invention.

I claim:

1. A paintball gun barrel system, the paintball gun having a main body with a paintball discharge port, the paintball gun barrel system comprising:

a hollow tubular barrel back having first end that is adapted to be removably attached to the discharge port of the paintball gun and an opposing second end;

a magnet located on the second end of the barrel back;

a hollow tubular barrel tip having a first inner surface, a coupling end and a portend, the coupling end of the barrel tip having magnetically attractive material thereat, the coupling end received within a seat on the second end of the barrel back such that the coupling end is magnetically coupled to the magnet, the coupled barrel tip and barrel port forming a continuous first hollow interior;

a hollow tubular barrel insert having a second inner surface, an outer surface, a second hollow interior, a breach end and a muzzle end such that the barrel insert is received within the first hollow interior formed by the coupled barrel back and barrel tip such that the breach end of the barrel insert abuts the paintball gun;

a series of first ports located on the barrel tip proximate the port end; and a series of second ports located on the barrel insert proximate the muzzle end, such that the first ports align with the second ports.

2. The paintball barrel system as in claim 1 wherein the magnet is a ring magnet.

3. The paintball barrel system as in claim 1 further comprising:

a peg located on the outer surface of the barrel insert; and a channel disposed within the first inner surface of the barrel tip extending from the coupling end toward the port end, the peg received within the channel when the barrel insert is received within the first hollow interior.

4. The paintball barrel system as in claim 1 wherein the barrel insert has a first inside diameter at the breach end and a second inside diameter located at the muzzle end such that the second diameter is greater than the first diameter.

5. The paintball barrel system as in claim 1 wherein the second inner surface of the barrel tip has a friction reducing coating thereon.

6. The paintball barrel system as in claim 1 in combination with the paintball gun.

7. The paintball barrel system as in claim 6 wherein the magnet is a ring magnet.

8. The paintball barrel system as in claim 6 further comprising:

a series of first ports located on the barrel tip proximate the port end; and a series of second ports located on the barrel insert such that the first ports align with the second ports.

9. The paintball barrel system as in claim 6 further comprising:

a peg located on the outer surface of the barrel insert; and a channel disposed within the first inner surface of the barrel tip extending from the coupling end toward the port end, the peg received within the channel when the barrel insert is received within the first hollow interior.

10. The paintball barrel system as in claim 6 wherein the barrel insert has a first inside diameter at the breach end and a second inside diameter located at the muzzle end such that the second diameter is greater than the first diameter.

11. The paintball barrel system as in claim 6 wherein the second inner surface of the barrel tip has a friction reducing coating thereon.

12. A paintball gun barrel system, the paintball gun having a main body with a paintball discharge port, the paintball gun barrel system comprising:

a hollow tubular barrel back having first end that is adapted to be removably attached to the discharge port of the paintball gun and an opposing second end;

a hollow tubular barrel tip having a first inner surface, a coupling end and a port end, the coupling end magnetically coupled to the second end of the barrel back, the coupled barrel tip and barrel port forming a continuous first hollow interior;

a hollow tubular barrel insert having a second inner surface, an outer surface, a second hollow interior, a breach end and a muzzle end such that the barrel insert is received within the first hollow interior formed by the coupled barrel back and barrel tip such that the breach end of the barrel insert abuts the paintball gun;

a peg located on the outer surface of the barrel insert; and a channel disposed within the first inner surface of the barrel tip extending from the coupling end toward the port end, the peg received within the channel when the barrel insert is received within the first hollow interior.

13. The paintball barrel system as in claim 12 further comprising:

a series of first ports located on the barrel tip proximate the port end; and a series of second ports located on the barrel insert such that the first ports align with the second ports.

14. The paintball barrel system as in claim 13 wherein the barrel insert has a first inside diameter at the breach end and a second inside diameter located at the muzzle end such that the second diameter is greater than the first diameter.

15. The paintball barrel system as in claim 13 wherein the second inner surface of the barrel tip has a friction reducing coating thereon.

16. The paintball barrel system as in claim 13 in combination with the paintball gun.

17. The paintball barrel system as in claim 16 further comprising:

a series of first ports located on the barrel tip proximate the port end; and a series of second ports located on the barrel insert such that the first ports align with the second ports.

18. The paintball barrel system as in claim 16 further comprising:

a peg located on the outer surface of the barrel insert; and a channel disposed within the first inner surface of the barrel tip extending from the coupling end toward the port end, the peg received within the channel when the barrel insert is received within the first hollow interior.

19. The paintball barrel system as in claim 16 wherein the barrel insert has a first inside diameter at the breach end and a second inside diameter located at the muzzle end such that the second diameter is greater than the first diameter.

20. The paintball barrel system as in claim 16 wherein the second inner surface of the barrel tip has a friction reducing coating thereon.

* * * * *